US005685103A

United States Patent [19]

Wiggins

[11] Patent Number: 5,685,103

[45] Date of Patent: Nov. 11, 1997

[54] GUN SUPPORT

[75] Inventor: Erick Devoan Wiggins, Timmonsville, S.C.

[73] Assignee: Charles Eric Rabon, Timmonsville, S.C.

[21] Appl. No.: 634,745

[22] Filed: Apr. 19, 1996

[51] Int. Cl.[6] ..... F41A 35/00; A47B 97/00

[52] U.S. Cl. ..... 42/94; 211/64; 248/218.4; 248/219.4; 248/230.8; 248/324

[58] Field of Search ..... 42/94, 90; 211/64; 248/324, 218.4, 219.4, 230.8

[56] References Cited

U.S. PATENT DOCUMENTS

| | | | |
|---|---|---|---|
| 834,748 | 10/1906 | Nicholson . | |
| 2,463,107 | 3/1949 | Holroyd | 42/94 |
| 2,542,343 | 2/1951 | Merrill | 211/64 |
| 3,022,898 | 2/1962 | Loeb . | |
| 3,167,182 | 1/1965 | Calvin | 211/64 |
| 3,963,156 | 6/1976 | Perrin . | |
| 4,722,501 | 2/1988 | Ruhl . | |
| 5,205,523 | 4/1993 | Jones . | |
| 5,263,675 | 11/1993 | Roberts et al. | 248/219.4 |
| 5,287,643 | 2/1994 | Gilmore . | |
| 5,419,233 | 5/1995 | Mulvaney | 42/94 |
| 5,491,920 | 2/1996 | McCullers | 42/94 |

*Primary Examiner*—Michael J. Carone
*Assistant Examiner*—Theresa M. Wesson
*Attorney, Agent, or Firm*—Michael A. Mann, P.A.

[57] ABSTRACT

A device for supporting a gun from a tree where the gun has a scope and the device supports the gun from the scope. The devices comprises a plate adapted to be attached to a tree by the use of an adjustable strap that surrounds the tree, an arm pivotally attached to the plate and extending therefrom so that an elastic member may be attached to the end of the arm distal from the plate, and a harness having a body and a first and second belt connected to the elastic member. The first and second belt encircle the front end and back end of the scope, respectively, and support the gun. The first and second belts are adjustable so that the gun can be balanced within the harness.

18 Claims, 2 Drawing Sheets

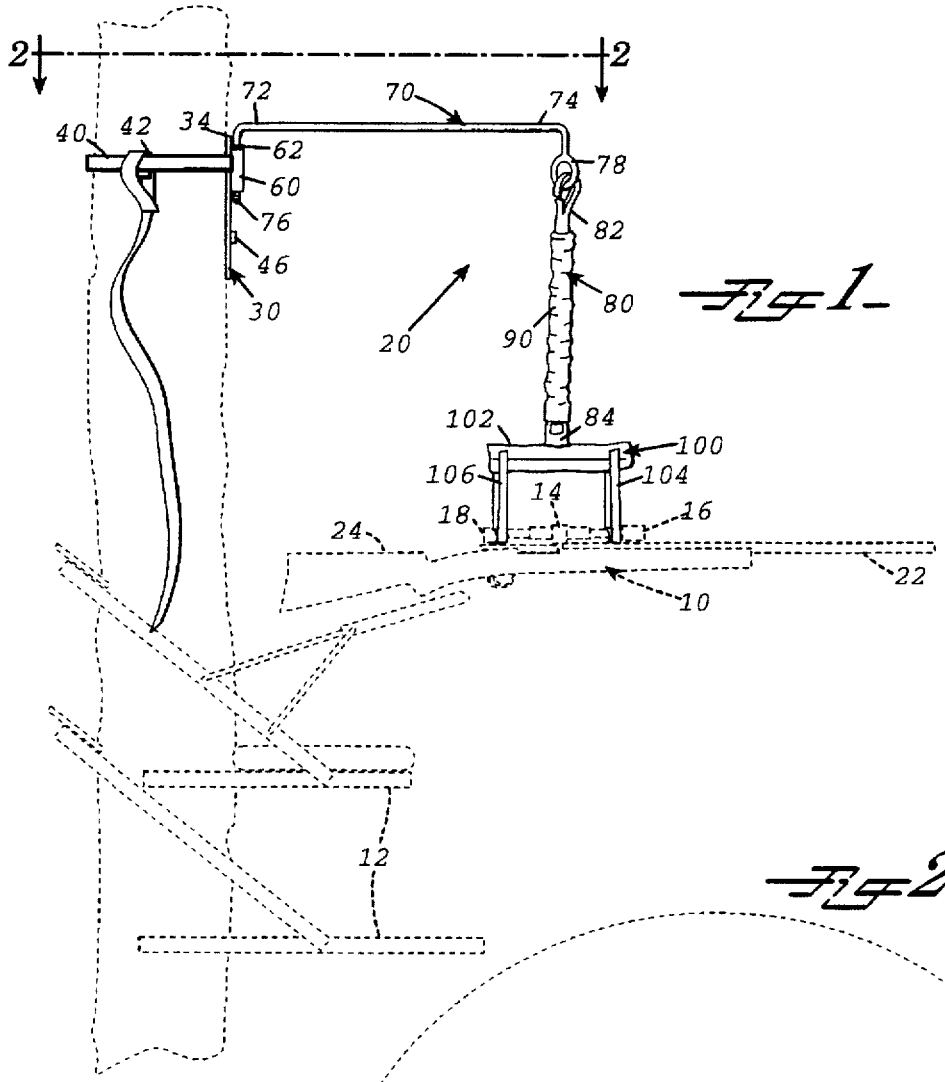
Fig 1
Fig 2
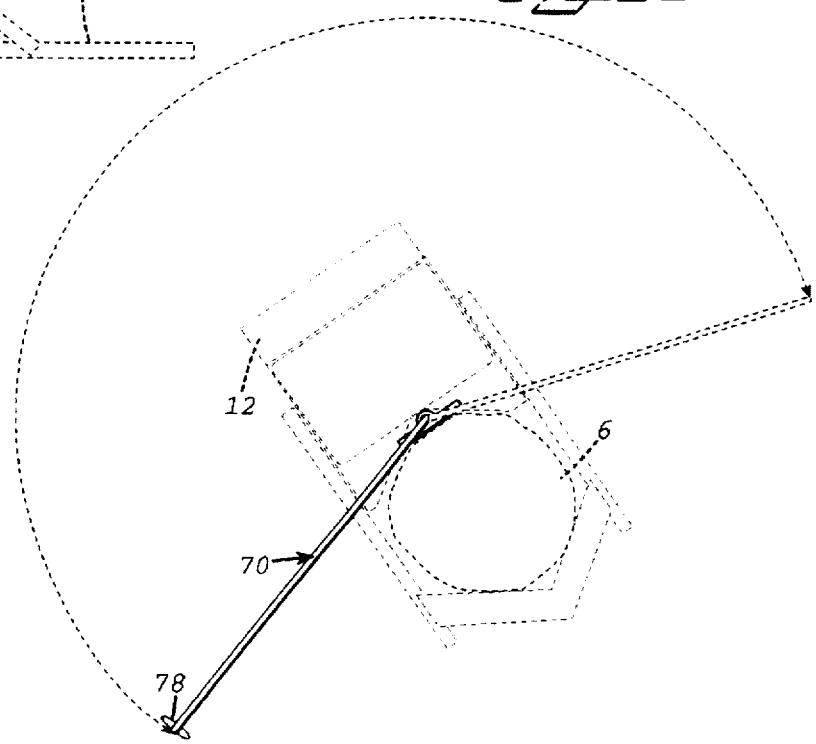

GUN SUPPORT

BACKGROUND OF THE INVENTION

1. Field of the Invention

The present invention relates to hunting equipment and accessories. In particular, the present invention relates to a device for adjustably and flexibly supporting a gun from a tree.

2. Discussion of Background

A hunter who awaits the approach of game on a hunting stand can spend long hours in idleness. During such idle time, there is no need for the hunter to be clutching his rifle. Furthermore, there are times when the hunter may need both hands free, so that the hunter can use a device or attractant to lure the game towards the stand. However, because the hunter needs to have the rifle accessible and ready to fire once the game is in range, the rifle must be easily located and positioned for firing.

It should also be noted that if the hunter is not holding or clutching the rifle at all times, the hunter must be able to bring the rifle to firing position without much commotion, or he risks spooking the game. Consequently, there is a need for a device for supporting a rifle proximate to the hunter's stand, so that when game is in range, the hunter may position the rifle quickly and easily in order to get off an accurate shot.

SUMMARY OF THE INVENTION

According to its major aspects and broadly stated, the present invention is a gun support that supports a gun, preferably a rifle having a scope, from a tree or other hunting device, such as a tripod stand. The support comprises a plate having an arm pivotally attached thereto. The plate is attached to the tree by the use of a strap adapted to surround the tree and a device that permits the strap to be tightened. The plate may also be further fastened to the tree by a second fastening device. This device may include another strap positioned at the base of the plate or a screw that penetrates the tree. The arm has a perpendicular finger extension at one end and a ring at the other, so that an elastic member may be connected to the ring. The arm is pivotally attached to the plate by an annular sleeve having a bearing therein that is designed to receive the finger extension. The elastic member is a resilient cord enclosed within a cloth casing to reduce the elastic member's contrast and subsequent noise.

Additionally, a harness is attached to the end of the elastic member distal to the arm, wherein the harness supports the gun by its scope. The harness comprises a body having a first belt and a second belt wherein the belts surround the front end and back end of the scope, respectively, thus supporting the rifle. Each belt has a buckle to ensure that the belts are securely fashioned about the ends of the scope. Furthermore, the belts are adjustable so that guns having different weight distributions may be supported at a predetermined angle with respect to the ground.

An important feature of the present invention is the elastic member that supports the rifle. The elastic member enables the hunter to have easy access to the rifle without the necessity of supporting its complete weight. Furthermore, the elastic member allows the hunter to move the rifle to a variety of positions with respect to the stand, so that the hunter can get off an accurate shot.

Another important feature of the present invention is that the arm supporting the rifle is pivotable with respect to the plate. This enables the hunter to pivot the arm and the harness around the tree, and in combination with the elastic member helps the hunter have an accurate shot at approaching game, no matter from which direction the game approaches the stand.

Still another feature of the present invention is the bearing within the annular sleeve of the plate to pivotally support the arm. The bearing allows the arm to be pivoted with respect to the tree or other device without any scraping or other sound that might result from metal grinding on metal. This is important, as any unnatural sounds may tend to spook the game.

Yet another feature of the present invention is the cooperation of the plate and strap to secure the gun support to the tree. The tightening buckle on the strap allows the strap to be used and securely fastened to a variety of different sized trees, without regard to limbs and branches, thus enabling the gun support to be positioned proximate to the hunter's stand without much difficulty. Furthermore, the second fastening device more securely fastens the plate to the tree so that when the arm is pivoted, the plate does not become disoriented with respect to the tree.

Still another feature of the present invention is the harness descending from the elastic member. The harness, having a first belt and second belt that surround the front end and back end of the scope, respectively, holds the rifle securely in position. With the harness surrounding the ends of the scope, the rifle is less likely to fall out of its restraints, rather than if the harness only cupped the bottom of the rifle. Furthermore, the adjustability of the belts enables the harness to support at a given angle guns having different weight distributions.

Yet another feature of the present invention is the cloth casing for the elastic member. As stated above, it is important not to frighten approaching game. Consequently, the cloth casing muffles any sound that might emanate from the elastic member as it is stretched and deformed. Furthermore, because certain game have excellent eyesight, it is important to break any straight lines. Therefore, the use of the cloth casing disrupts the straight line pattern that the elastic member would otherwise provide.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 1 is a side view of the gun support attached to a tree showing a hunter's tree stand in phantom lines for clarity, according to a preferred embodiment of the present invention;

FIG. 2 is a cross-sectional view taken along line 2—2 of FIG. 1, showing the extent the arm of the gun support is able to swing, according to a preferred embodiment of the present invention;

DETAILED DESCRIPTION OF A PREFERRED EMBODIMENT

Figure 4:
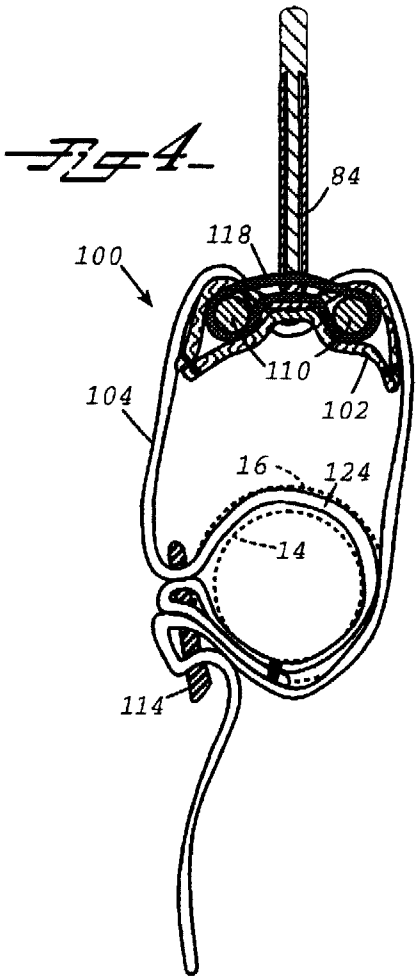
FIG. 4 is a cross-sectional view of a harness taken along line 4—4 in FIG. 3, according to a preferred embodiment of the present invention.

Referring now to FIGS. 1 and 2, a gun support 20 is shown attached to a tree 6 supporting a gun 10, according to a preferred embodiment. A hunter's stand 12 is also shown attached to tree 6 in order to provide a perspective and general view of gun support 20. Now referring to all the figures, gun support 20 comprises a plate 30 with an arm 70 pivotally attached thereto and a strap 40 that secures plate 30 to tree 6.

In the preferred embodiment, plate 30 is rectangular in shape, with its major longitudinal axis 32 extending along the height of tree 6. At the top end 34 of plate 30 are two slots 36 through which strap 40 is inserted. One end of strap 40 is joined to a buckle 42, of the type known in the art that threadably receives the other end of strap 40 and is able to securely tighten strap 40 around the circumference of tree 6. The cooperation of strap 40 surrounding the circumference of tree 6 and buckle 42, which tightens strap 40, function to securely hold plate 30 to tree 6.

In the preferred embodiment, there is a second fastening device that is used to further secure plate 30 to tree 6. Second fastening device will prevent plate 30 from pivoting or becoming disoriented on tree 6 as arm 70 and gun 10 are pivoted, thus shifting the weight and support experienced by plate 30. Those of ordinary skill in the art will recognize that several different types of fastening devices can he used for second fastening device. For example, as shown in the figures, a screw 46 that extends through plate 30 and penetrates tree 6 will prevent plate 30 from pivoting with respect to tree 6. Another strap, similar to strap 40, could also be used at the bottom end of plate 30 to prevent plate 30 from pivoting on tree 6. An additional strap would further secure plate 30 to tree 6 without damaging tree 6.

Figure 3:
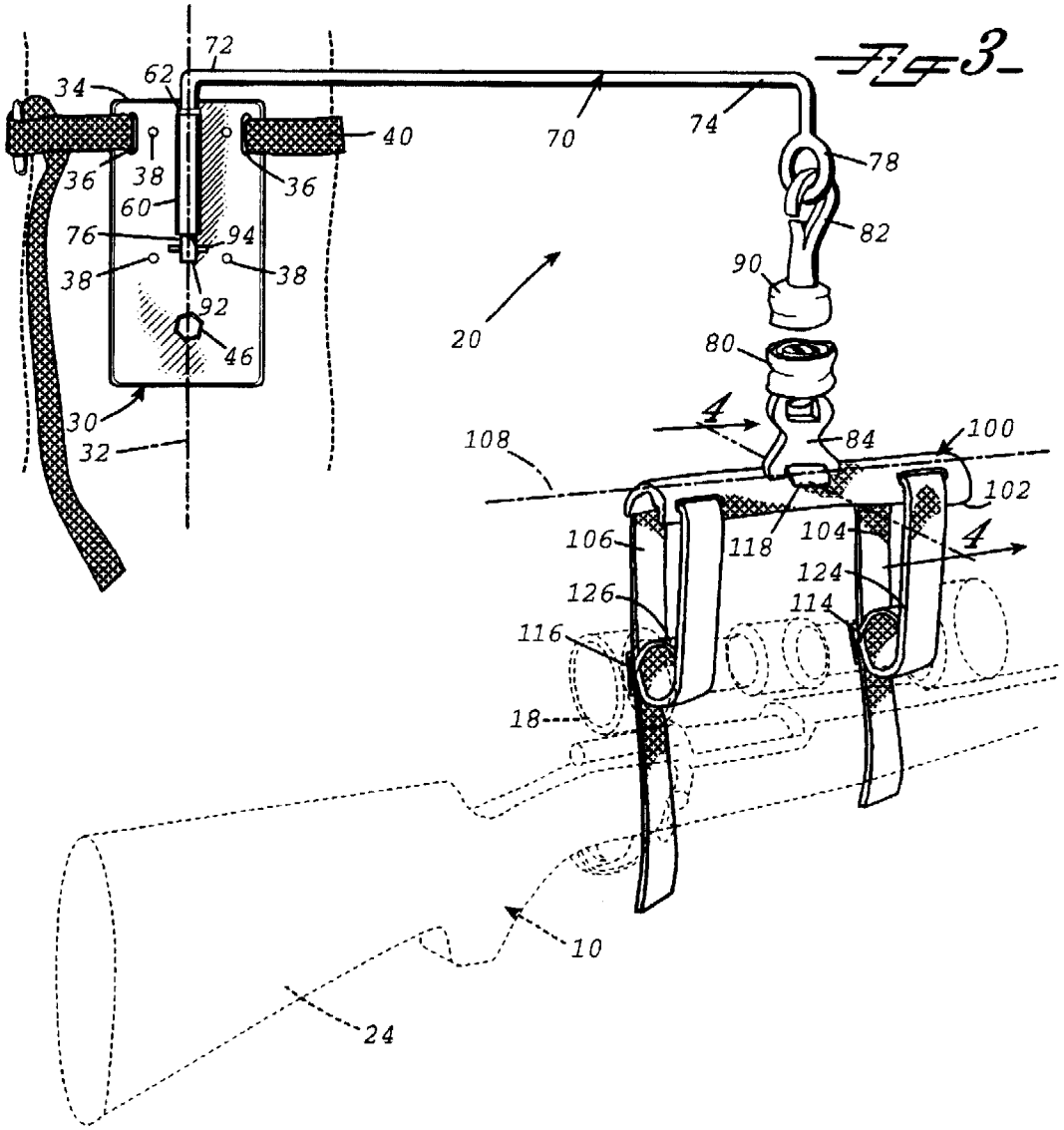
FIG. 3 is a detailed perspective of a harness of the gun support according to a preferred embodiment of the present invention.

Additionally, as seen in FIG. 3, plate 30 is provided with a plurality of holes 38 therethrough. Those of ordinary skill in the art will recognize that holes 38 can be used either to permanently attach plate 30 to tree 6, or to more securely attach plate 30 to tree 6.

It is contemplated by the present invention that gun support 20 could be attached to structures other than tree 6, such as a tripod stand or other hunting stand. Consequently, those of ordinary skill in the art will recognize other ways of adapting gun support 20 to other support devices without departing from the spirit and scope of the present invention.

Attached to plate 30 and positioned proximate to top end 34, is an annular sleeve 60 running along longitudinal axis 32 of plate 30. Within annular sleeve 60 is disposed a bearing 62 having a channel (not shown) extending therethrough. Arm 70 comprises a first end 72 and a second end 74, wherein first end 72 has a finger extension 76 extending approximately perpendicularly therefrom. Finger extension 76, annular sleeve 60, and bearing 62 are dimensioned so that finger extension 76 pivotally fits within the channel of bearing 62. Bearing 62 provides a smooth surface for finger extension 76 to pivot against, so that arm 70 pivots smoothly and quietly with respect to plate 30. It is important for arm 70 to pivot quietly, so that its movement does not cause extraneous sounds that might frighten approaching game.

Those skilled in the art will also recognize that finger extension 76 may be secured within beating 62 by the insertion of a cotter pin 94 at the bottom end 92 of finger extension 76. Moreover, it should be recognized that there are other methods of securing finger extension 76 within bearing 62, for example, by crimping bottom end 92.

In FIG. 2, the range that arm 70 is able to pivot is shown. It will be appreciated that arm 70 may pivot until engaging tree 6; thus, the only restriction to the range of arm 70 is related to the size of tree 6.

Arm 70 extends away from plate 30 and tree 6 until second end 74 ends in a ring 78 that extends perpendicularly downward from arm 70. Arm 70 is a rod of preferably metallic material, and along with plate 30 is coated or formed from a non-corrosive material. Additionally, plate 30 and arm 70 should be constructed from or coated by a material that is dark or glare resistant, so that the materials do not alert approaching game to the hunter's presence.

An elastic member 80 descends from arm 70 with a harness 100 attached to its opposing end. In the preferred embodiment, elastic member 80 is a bungee cord that is able to support gun 10, but is resilient enough to stretch or contract depending on the amount of, and direction of force applied to gun 10. However, those of ordinary skill in the art will recognize that other types of elastic members 80 may be used without departing from the spirit and scope of the present invention.

Elastic member 80 is attached to arm 70 by a first clip 82 that engages ring 78, so that elastic member 80 is securely held in position but may be removed by manual force. Additionally, an extendable cloth casing 90 encloses elastic member 80, so that as elastic member 80 stretches, cloth casing 90 continues to enclose elastic member 80. In the preferred embodiment, cloth casing 90 is constructed from a camouflage textile fabric that also functions to distort the appearance of elastic member 80 so that it does not spook approaching game. Furthermore, cloth casing 90 will also muffle any sound created by its stretching and contracting during movement, thus reducing the likelihood of frightening approaching game.

As stated above, harness 100 is connected to elastic member 80; however, in the preferred embodiment, elastic member 80 is connected to harness 100 by a second clip 84, thus enabling harness 11210 to be detached from elastic member 80. It will be recognized that other types of clips may be substituted for first clip 82 and second clip 84 without departing from the spirit and scope of the present invention.

Harness 100 comprises a body 102, a first belt 104, and a second belt 106. Body 102 has a longitudinal axis 108 extending its length and has a pair of rods 110 internally positioned within body 102 on either side of longitudinal axis 108. Rods 110 provide rigid support to harness 100, so that it does not bend or flex perpendicularly to its longitudinal axis 108. Second clip 84 is secured to body 102 of harness 100 by a member 118 that engages one rod 110, passes through second clip 84, and engages the other rod 110, thus securing second clip 84 to harness 100.

First belt 104 and second belt 106 are disposed on opposite sides of body 102 and are formed similar to each other. First belt 104 comprises a length of flat cord or leather that is threaded through body 102 so that first belt 104 extends over rods 110. First belt 104 also comprises a first buckle 114, through which first belt 104 is threaded, so that first belt 104 forms a first loop 124 positioned beneath body 102. Second belt 106 also comprises a length of flat cord or leather that is threaded through body 102 so that second belt 106 extends over rods 110. Additionally, second belt 106 further comprises a second buckle 116 through which second belt 106 is threaded to form a second loop 126 positioned beneath body 102.

In the preferred embodiment, gun 10 has a scope 14 having a front end 16 proximate to the front of the barrel 22 of gun 10, and a back end 18 proximate to the stock 24 of gun 10. In operation, first loop 124, created by first belt 104 and first buckle 114, encircles front end 16 of scope 14, and second loop 126 created by second belt 106 and second buckle 116 encircles back end 18 of scope 14. First buckle 114 and second buckle 116 provide adjustability to first loop 124 and second loop 126, respectively, thus enabling gun 10 to be balanced irrespective to the weight distribution along the length of gun 10. For instance, if barrel 22 is relatively heavy, first loop 124 can be adjusted or tightened so that barrel 22 is still in a horizontal and balanced position. The cooperation of first belt 104 and first buckle 114, to form first loop 124, enables this type of adjustment. Those of ordinary skill in the art will recognize that the cooperation of second belt 106 and second buckle 116 forming second loop 126, function and perform substantially similar to first belt 104. Furthermore, those of ordinary skill in the art will recognize the equivalent methods of adjusting first belt 104 and second belt 106 that are feasible without scope of the present spirit and scope of the present invention.

The present invention securely holds gun 10 by its scope 14, so that when a hunter is in tree stand 12, the hunter may move and pull gun 10 into any orientation to obtain an accurate shot at approaching game.

It will be apparent to those skilled in the art that many changes and substitutions can be made to the preferred embodiment herein described without departing from the spirit and scope of the present invention as defined by the appended claims.

What is claimed is:

1. A device for supporting a gun from a structure, said gun having a scope attached thereto, said device comprising:

means for securing said device to the structure;

an arm pivotally attached to said securing means and extending therefrom; and an elastic member attached to said arm for elastically supporting said gun from said scope.

2. The device as recited in claim 1, wherein said structure is a tree and said securing means further comprises:

a plate adapted to be attached to said tree;

a strap connected to said plate, said strap adapted to surround said tree and secure said plate to said tree; and a second fastener for securing said plate to said tree.

3. The device as recited in claim 1, wherein said structure is a tree and wherein said securing means further comprises:

a plate adapted to be attached to said tree, said plate having a top end;

a strap attached to said top end of said plate; and means for tightening said strap.

4. The device as recited in claim 1, wherein said scope has a front end and a back end, and further comprising a harness having a body, said harness depending from said elastic member, said body having a pair of rods therein;

a first belt carried by said body, said first belt encircling said front end of said scope; and a second belt carried by said body, said second belt encircling said back end of said scope.

5. The device as recited in claim 1, wherein said arm further comprises:

a rod having a first end and a second end;

a finger extending from said first end of said rod approximately perpendicular to said rod;

a ring carried by said second end of said rod; and wherein said elastic member is attachable to said ring of said arm.

6. A device for supporting a gun from a tree, said gun having a scope attached thereto, said device comprising:

a plate having a top end, said plate adapted to be attached to said tree;

an arm pivotally attached to said plate;

an elastic member attached to said arm; and a harness carried by said elastic member for supporting said gun from said scope.

7. The device as recited in claim 6, wherein said arm further comprises:

a rod having a first end and a second end;

a finger extending from said first end of said rod approximately perpendicular to said rod;

a ring carried by said second end of said rod; and said supporting member further comprising an elastic member which is attachable to said ring of said arm.

8. The device as recited in claim 6, wherein said harness further comprises means for adjustably supporting said gun from said scope.

9. The device as recited in claim 6, wherein said scope has a front end and a back end, said harness further comprising:

a body;

a first belt carried by said body, said first belt encircling said front end of said scope; and a second belt carried by said body, said second belt encircling said back end of said scope.

10. The device as recited in claim 6, further comprising:

a strap connected to said top end of said plate, said strap adapted to surround said tree and secure said plate to said tree; and a second fastening device for securing said plate to said tree.

11. The device as recited in claim 6, wherein said arm further comprises:

a rod having a first end; and a finger extending from said first end approximately perpendicular to said rod; and said plate further comprising:

an annular sleeve; and a bearing positioned within said sleeve and dimensioned to receive said finger of said arm.

12. A device for supporting a gun from a tree, said gun having a scope attached thereto, said device comprising:

a plate having a top end;

a strap attached to said top end of said plate and adapted to surround said tree;

an arm pivotally carried by said plate;

an elastic member attached to said arm; and means depending from said elastic member for adjustably supporting said gun from said scope.

13. The device as recited in claim 12, wherein said strap further comprises means for tightening said strap around said tree.

14. The device as recited in claim 12, further comprising means carried by said plate for fastening said plate to said tree.

15. The device as recited in claim 12, wherein said elastic member is covered by a camouflage fabric.

16. The device as recited in claim 12, wherein said scope has a front end and a back end, said device further comprising:

a body;

a first belt carried by said body, said first belt forming a first loop and encircling said front end of said scope;

first means carried by said first belt for adjustably securing said first loop about said scope;

a second belt carried by said body, said second belt forming a loop and encircling said back end of said scope; and second means carried by said second belt for adjustably securing said second loop about said scope.

17. The device as recited in claim 12, wherein said arm further comprises:

a rod having a first end and a second end;

a finger extending from said first end approximately perpendicular to said rod; and a ring carried by said second end, said elastic member having means for connecting said elastic member to said ring of said arm.

18. The device as recited in claim 12, wherein said arm further comprises:

a rod having a first end; and a finger extending from said first end approximately perpendicular to said rod, and said plate further comprising:

a annular sleeve; and a bearing positioned within said sleeve and dimensioned to receive said finger of said arm.

* * * * *